US007099612B2

(12) United States Patent
Choi et al.

(10) Patent No.: US 7,099,612 B2
(45) Date of Patent: Aug. 29, 2006

(54) TONER CARTRIDGE USED WITH ELECTROPHOTOGRAPHIC IMAGE FORMING APPARATUS

(75) Inventors: Sam-seok Choi, Suwon-si (KR); Myoung-su Baek, Suwon-si (KR); Dong-hoon Park, Osan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 111 days.

(21) Appl. No.: 10/968,180

(22) Filed: Oct. 20, 2004

(65) Prior Publication Data

US 2005/0084300 A1 Apr. 21, 2005

(30) Foreign Application Priority Data

Oct. 20, 2003 (KR) ..... 10-2003-0072988
Nov. 24, 2003 (KR) ..... 10-2003-0083635

(51) Int. Cl.
*G03G 15/08* (2006.01)

(52) U.S. Cl. ..... 399/281; 399/279; 399/252; 399/192

(58) Field of Classification Search ..... 399/102, 399/222, 252, 262, 263, 265, 273, 279, 281, 399/282

See application file for complete search history.

(56) References Cited

U.S. PATENT DOCUMENTS 4,328,762 A * 5/1982 Wada ..... 399/236
4,903,634 A * 2/1990 Ono et al. ..... 399/281
4,987,452 A * 1/1991 Nakagawa et al. ..... 399/279
5,075,728 A * 12/1991 Kobayashi et al. ..... 399/281
5,177,323 A * 1/1993 Kohyama ..... 399/222
5,223,898 A * 6/1993 Fujii et al. ..... 399/279
5,317,370 A * 5/1994 Kohyama et al. ..... 399/222
5,640,651 A * 6/1997 Katoh et al. ..... 399/281
5,794,109 A * 8/1998 Ota et al. ..... 399/279
5,809,386 A * 9/1998 Iwata ..... 399/281
5,848,336 A * 12/1998 Hazama et al. ..... 399/265
5,848,342 A * 12/1998 Tanda ..... 399/358
6,125,250 A * 9/2000 Kamio et al. ..... 399/98
6,424,813 B1 * 7/2002 Hatakeyama ..... 399/279
6,501,923 B1 * 12/2002 Aoki et al. ..... 399/96
6,519,437 B1 * 2/2003 Aoki et al. ..... 399/281

(Continued)

FOREIGN PATENT DOCUMENTS

JP 08-095469 4/1996

(Continued)

*Primary Examiner*—Arthur T. Grimley
*Assistant Examiner*—Ryan D. Walsh
(74) *Attorney, Agent, or Firm*—Stanzione & Kim, LLP

(57) ABSTRACT

A toner cartridge used with an electrophotographic image forming apparatus includes a developing roller that develops an electrostatic latent image formed on an outer circumferential surface of a photosensitive drum, a toner supplying roller that supplies toner onto the developing roller, a main chamber that stores the toner, a guide member that is disposed under the toner supplying roller to receive the toner and to guide the toner toward the developing roller, a toner recovery chamber that is formed under the guide member to form a space where the toner remaining on the guide member, which is not supplied to the developing roller, can accumulate, a recovery roller that rotates in the toner recovery chamber to return the toner in the toner recovery chamber to the main chamber, and a toner blocking film that is installed on a lower portion of the guide member to prevent the toner from directly leaking to the toner recovery chamber.

29 Claims, 6 Drawing Sheets

U.S. PATENT DOCUMENTS

| | | | | |
|---|---|---|---|---|
| 6,775,506 | B1 * | 8/2004 | Endoh et al. | 399/284 |
| 2002/0012551 | A1 * | 1/2002 | Tsutsui et al. | 399/281 |
| 2003/0113139 | A1 * | 6/2003 | Yasukawa et al. | 399/281 |
| 2005/0111887 | A1 * | 5/2005 | Choi et al. | 399/281 |

FOREIGN PATENT DOCUMENTS

| | | |
|---|---|---|
| JP | 09-090848 | 4/1997 |
| JP | 2001-255727 | 9/2001 |
| JP | 2002-006637 | 1/2002 |

* cited by examiner

TONER CARTRIDGE USED WITH ELECTROPHOTOGRAPHIC IMAGE FORMING APPARATUS

CROSS-REFERENCE TO RELATED APPLICATIONS

This application claims the priorities of Korean Patent Applications No. 2003-72988, filed on Oct. 20, 2003, and No. 2003-83635, filed on Nov. 24, 2003, in the Korean Intellectual Property Office, the disclosures of which are incorporated herein in their entirety by reference.

BACKGROUND OF THE INVENTION

1. Field of the Invention

The present general inventive concept relates to a toner cartridge used with an electrophotographic image forming apparatus, and more particularly, to a toner cartridge used with an electrophotographic image forming apparatus, which includes a unit to effectively recover toner from a developing roller and a toner supplying roller.

2. Description of the Related Art

An electrophotographic image forming apparatus, such as a dry type color laser printer, is an apparatus that forms an electrostatic latent image on a photosensitive substance, develops the image using powder toner, and transfers the developed image on a sheet of paper through a predetermined transferring medium to form the image on the paper. The image forming apparatus includes a toner cartridge as a developing unit, which is disposed to access the photosensitive substance and contains dry toner, to develop the electrostatic latent image of the photosensitive substance.

Japanese Laid-open Patent No. 2001-255727 discloses a developing apparatus including a developing roller, and a toner cartridge that supplies toner to the developing apparatus. The toner cartridge is vertically disposed to supply the toner to a toner chamber in the developing apparatus. Thus, a printer including the above developing apparatus requires a large vertical volume.

In a dry type color printer having a compact structure, a toner cartridge is formed in a horizontal direction as a developing unit, thus requiring a structure, in which toner cartridges of a plurality of colors are vertically stacked.

SUMMARY OF THE INVENTION

In order to solve the foregoing and/or other problems, it is an aspect of the present general inventive concept to provide a toner cartridge that includes a unit to prevent toner supplied to a toner supplying roller from leaking to a toner recovery chamber.

Additional aspects and advantages of the present general inventive concept will be set forth in part in the description which follows and, in part, will be obvious from the description, or may be learned by practice of the general inventive concept.

The foregoing and/or other aspect of the present general inventive concept, may be achieved by providing a toner cartridge including, a developing roller that develops an electrostatic latent image formed on an outer circumferential surface of a photosensitive drum, a toner supplying roller that supplies toner onto the developing roller, a main chamber that stores the toner, a guide member that is disposed under the toner supplying roller to receive the toner and to guide the toner toward the developing roller, a toner recovery chamber that is formed under the guide member to form a space where the toner remaining on the guide member, which is not supplied to the developing roller, can accumulate, a recovery roller that rotates in the toner recovery chamber to return the toner in the toner recovery chamber to the main chamber, and a toner blocking film that is installed on a lower portion of the guide member to prevent the toner from directly leaking to the toner recovery chamber.

The foregoing and/or other aspect of the present general inventive concept may also be achieved by providing a toner cartridge used with an electrophotographic image forming apparatus, the toner cartridge including a housing having a main chamber containing a toner, and an opening, a guide member disposed to guide the toner from the main chamber toward the opening through a guide path, a developing roller disposed to supply the guided toner to an outside of the housing through the opening, a toner recovery chamber disposed opposite to the guide path with respect to the guide member to recover the toner from the developing roller and to store the recovered toner therein, a toner recovery roller disposed in the toner recovery chamber to transfer the recovered toner from the toner recovery chamber to the main chamber; and a toner blocking film unit disposed between the guide member and the toner recovery roller to prevent the toner from being transferred from the main chamber to the toner recovery chamber.

The foregoing and/or other aspect of the present general inventive concept, may also be achieved by providing an electrophotographic image forming apparatus including a photosensitive drum and a toner cartridge that includes a housing having a main chamber containing a toner, and an opening, a guide member disposed to guide the toner from the main chamber toward the opening through a guide path, a developing roller disposed to supply the toner to the photosensitive drum disposed outside the housing through the opening, a toner recovery chamber formed between the guide member and a bottom surface of the housing and disposed opposite to the guide path with respect to the guide member to recover the toner from the developing roller, a toner recovery roller disposed in the toner recovery chamber to transfer the recovered toner from the toner recovery chamber to the main chamber; and a toner blocking film unit disposed between the guide member and the toner recovery roller to prevent the toner from being transferred from the main chamber to the toner recovery chamber.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
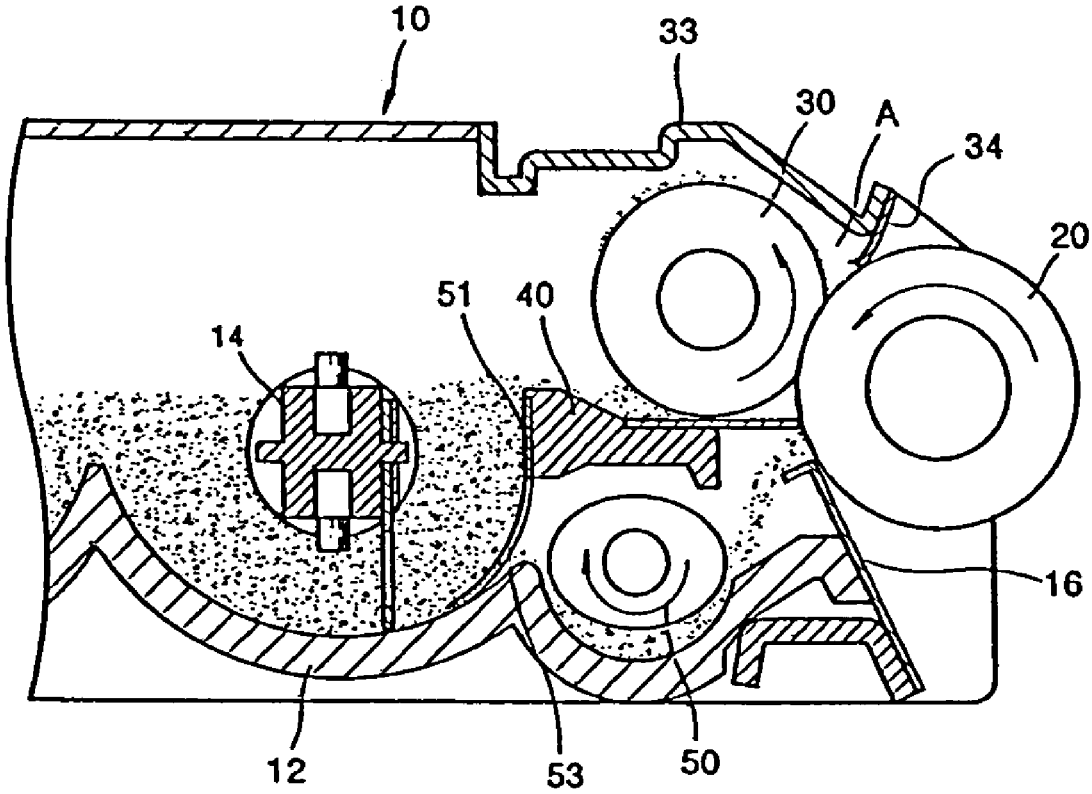
FIG. 1 is a partial cross-sectional view illustrating a toner cartridge in which toner is supplied in a horizontal direction.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a partial cross-sectional view illustrating a structure of a toner cartridge that supplies toner in a horizontal direction.

Referring to FIG. 1, a plurality of semicircular chambers 12 are sequentially formed at a lower portion of a housing 10, and each of the chambers 12 includes an agitator 14. A developing roller 20 is installed on a front end portion of the housing 10, and a toner supplying roller 30 is installed to contact the developing roller 20. A guide member 40 is disposed under the toner supplying roller 30 to receive the toner supplied from the agitator 14 and helps the toner attach on an outer circumference of the toner supplying roller 30. A recovery roller 50 is disposed under the guide member 40 to return remaining toner, which is not supplied to the developing roller 20 from the toner supplying roller 30, toward the chamber 12 including the first agitator 14.

The toner supplying roller 30 rotates in a rotating direction of the developing roller 20 to clean the toner remaining on a surface of the developing roller 20 by contacting the developing roller 20, and supplies the toner onto the surface of the developing roller 20 by compressing the toner on the surface of the developing roller 20 immediately before contacting the developing roller 20.

A doctor blade 16 is installed at the housing 10 to control a height of toner on the surface of the rotating developing roller 20 in order to remove an excessive toner from the developing roller 20.

The toner removed from the developing roller 20 by the doctor blade 16 and the toner passed through a toner path without being attached to the surface of the developing roller 20 from the toner supplying roller 30 are stored in a toner recovery chamber 52. The toner accumulating in the toner recovery chamber 52 is returned to the chamber 12 by a recovery roller 50 through a plurality of recovery holes 51 which are formed on a member 53 that blocks a passage between the guide member 40 and the chamber 12.

A seal bracket 33 is installed on an upper portion of the housing 10 to cover the developing roller 20 and the toner supplying roller 30 and to prevent the toner from leaking. A seal film 34 is attached to the seal bracket 33 to prevent the toner between the developing roller 20 and the toner supplying roller 30 from leaking out and to prevent external impurities from penetrating into the toner cartridge.

However, in the toner cartridge having the above structure, a toner flow may be interrupted since the toner that is supposed to be supplied to the guide member 40 from the first agitator 14 may be conveyed to the toner recovery chamber 52 through the recovery hole 51. Also, a flow of the returning toner may be reduced, and a load to drive the recovery roller 50 may increase due to the toner accumulating in the toner recovery chamber 52.

Figure 2:
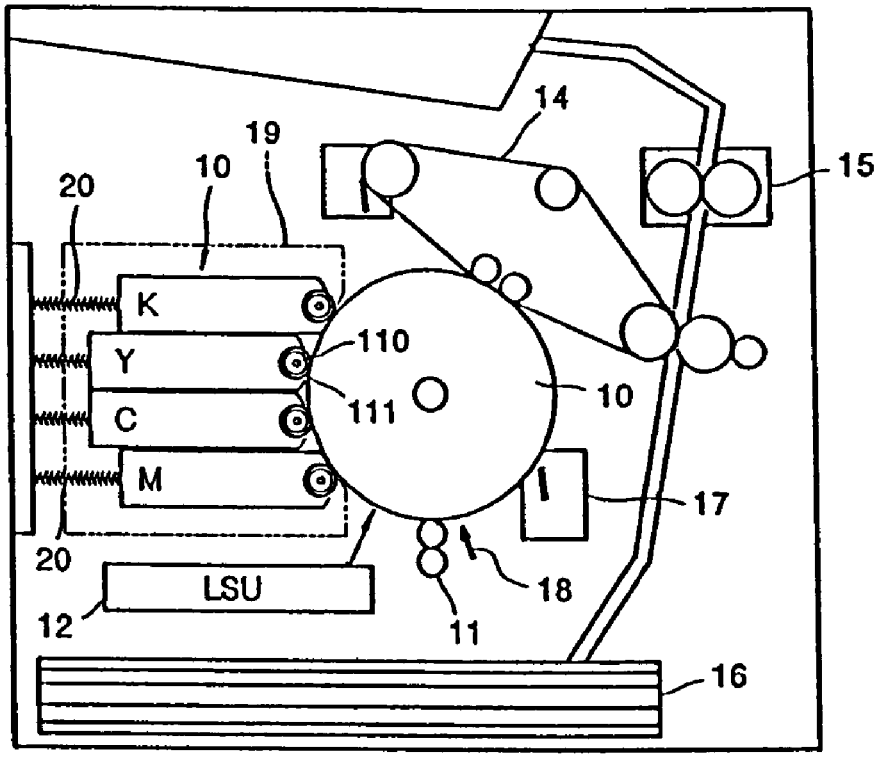
FIG. 2 is a view illustrating an electrophotographic image forming apparatus adopting toner cartridges according an embodiment of to the present general inventive concept.

FIG. 2 is a view illustrating an electrophotographic image forming apparatus including toner cartridges according to an embodiment of the present invention.

Referring to FIG. 2, the image forming apparatus may include a photosensitive drum 10, a charger 11 to charge the photosensitive drum 101, a laser scanning unit (LSU) 12 that is an exposure unit to form an electrostatic latent image by scanning light onto the charged photosensitive drum 101, a developing unit 19 having toner cartridges 10 (100M, 100C, 100Y, and 100K) that are developers to develop the electrostatic latent image with powder toners of four colors (yellow, magenta, cyan, and black), a transfer unit including a transfer belt 14 that receives the images of four colors developed on the photosensitive drum 101 and transfers the images on a sheet of paper, and a recording unit 15 that records the image on the paper by heating and pressing the paper. Reference numeral 16 denotes a paper cassette, reference numeral 17 denotes a photosensitive drum cleaning unit, and reference numeral 18 denotes an eraser.

Here, each of the toner cartridges 10 of the four colors 100M, 100C, 100Y, and 100K may include a developing roller 110 that supplies toner stored in the toner cartridge to an outer circumferential surface of the photosensitive drum 101 without contacting the photosensitive drum 101, and a gap maintaining roller 111 that is installed on a rotary shaft of the developing roller 110 and adheres to the photosensitive drum 101 to maintain a constant gap between the photosensitive drum 101 and the developing roller 110. Each of the toner cartridges 100 can be elastically biased toward the photosensitive drum 101 by a spring 20, so that the gap maintaining roller 111 adheres to the photosensitive drum 101.

The toner cartridges of the above structure can be stacked in a horizontal direction and can be applied to a compact color printer.

Figure 3:
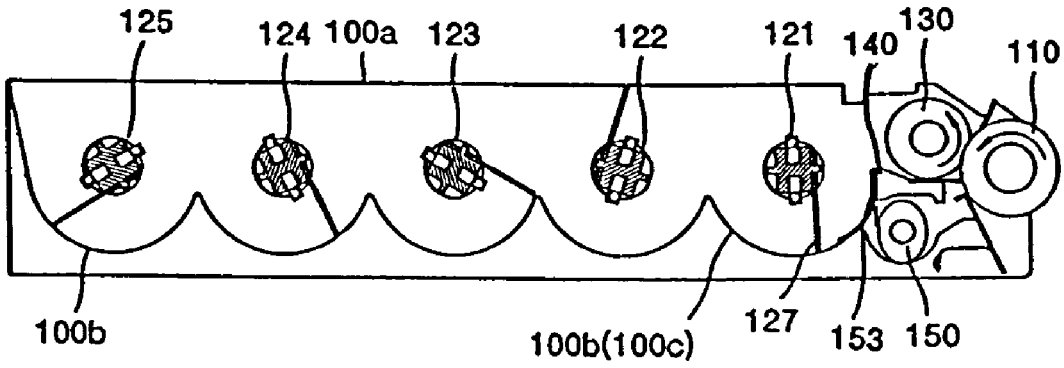
FIG. 3 is a cross-sectional view illustrating a toner cartridge of FIG. 2.
Figure 4:
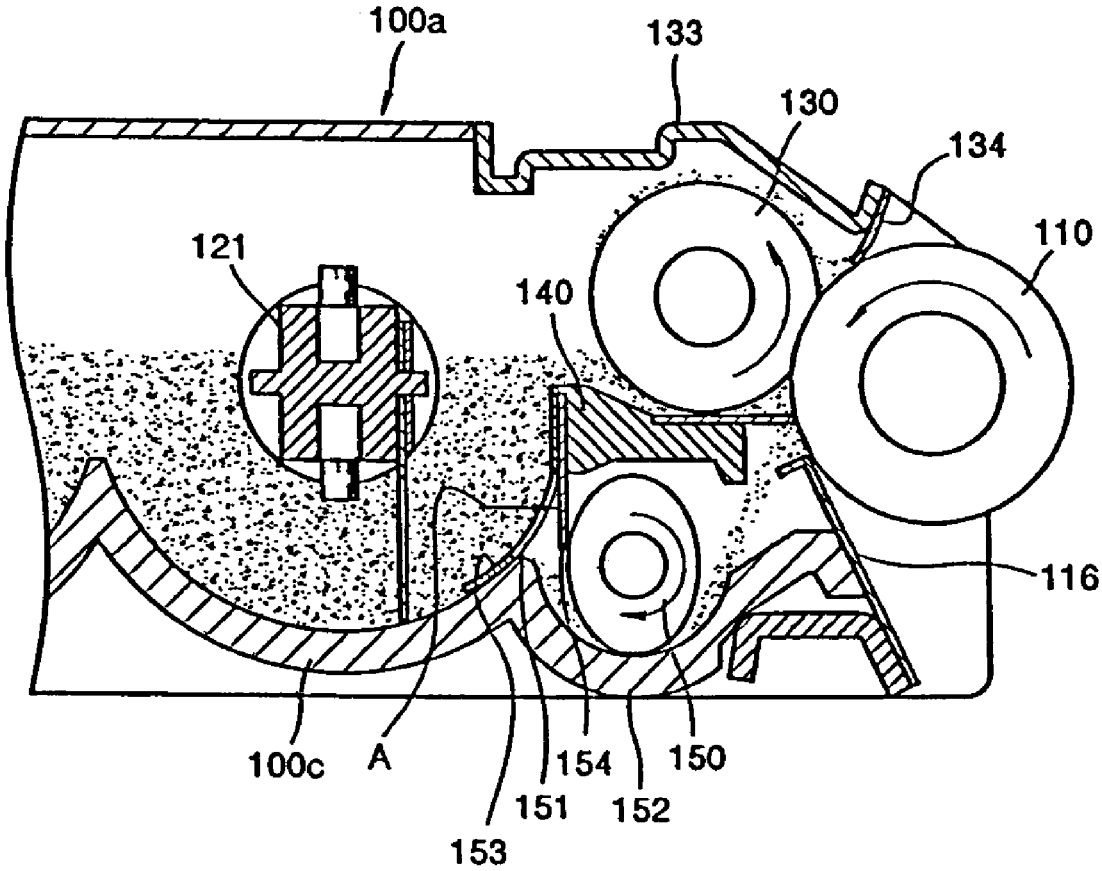
FIG. 4 is an enlarged view illustrating a portion of the toner cartridge FIG. 3.

FIG. 3 is a cross-sectional view illustrating the toner cartridge 10 of FIG. 2, and FIG. 4 is an enlarged view illustrating a portion of the toner cartridge 10 of FIG. 3.

Referring to FIGS. 3 and 4, five semicircular chambers 100*b* can be sequentially formed at a lower portion of a housing 100*a*, and each of the chambers 100*b* can include an agitator 121, 122, 123, 124, or 125. The developing roller 110 can be installed on a front end portion of the housing 100*a*, and the toner supplying roller 130 contacts the developing roller 110. A guide member 140 can be disposed under the toner supplying roller 130 to receive the toner supplied from the first agitator 121 and to control the toner to be attached to an outer circumference of the toner supplying roller 130. A recovery roller 150 can be disposed under the guide member 140 to recover the toner that is not supplied to the developing roller 110 from the toner supplying roller 130, toward a main chamber 100*c* where the first agitator 121 is installed.

The toner supplying roller 130 can rotate in the same direction as that of the developing roller 110 to clean the remaining toner on a surface of the developing roller 110 by contacting the developing roller 110. In addition, the toner supplying roller 130 can supply the toner onto the surface of the developing roller 110 by pressing the toner on the cleaned developing roller 110 immediately before contacting the developing roller 110.

A doctor blade 116 can be installed at the housing 100*a* to control the toner on the surface of the developing roller 110 that rotates, and removes an excessive toner from the developing roller 110.

The toner removed from the developing roller 110 by the doctor blade 116 and the toner passing through a toner path without being attached to the surface of the developing roller 110 can accumulate in a toner recovery chamber 152 that provides a rotation area of the recovery roller 150. The toner filled in the toner recovery chamber 152 can be conveyed to the main chamber 100*c* through a path between a lower portion of the guide member 140 and the main chamber 100*c* by the recovery roller 150.

A seal bracket 133 can be installed on an upper portion of the housing 100*a* to cover the developing roller 110 and the toner supplying roller 130 to prevent the toner leaking outward. A seal film 134 can be installed at the seal bracket 133 to contact the surface of the developing roller 110 to prevent the toner between the developing roller 110 and the toner supplying roller 130 from leaking and to prevent external impurities from penetrating into the toner cartridge.

Figure 5:
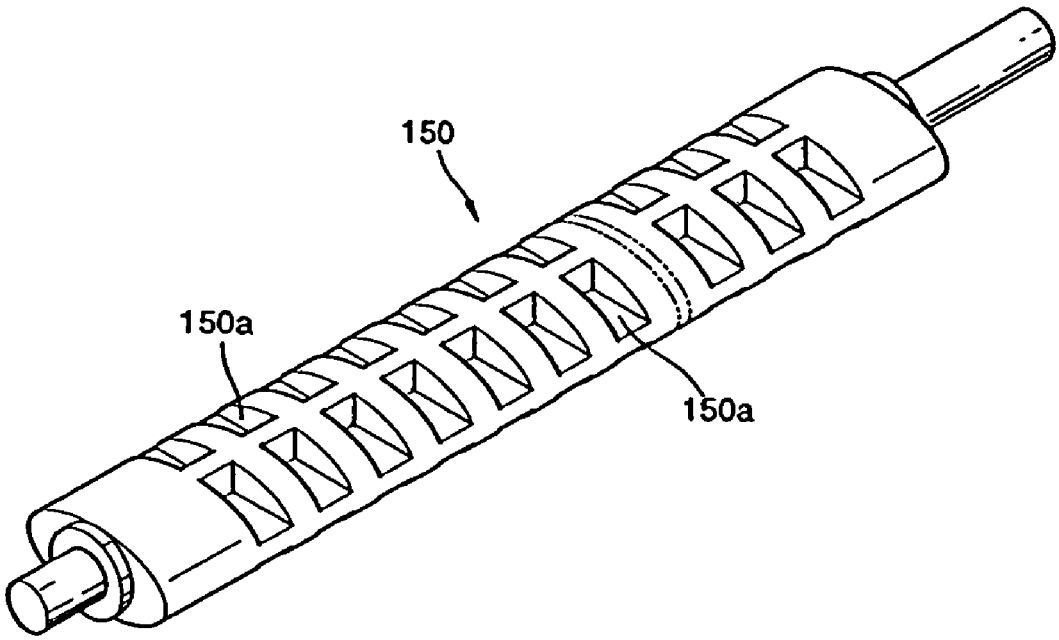
FIG. 5 is a perspective view illustrating a recovery roller of FIG. 3.

The recovery roller 150 may have an oval cross-section, as shown in FIG. 5, and a plurality of recesses 150*a* can be formed on an outer surface of the recovery roller 150 to store the toner therein.

A member 153 can be installed to block an opening portion formed between the guide member 140 and the main chamber 100*c*, and the member 153 can include a plurality of recovery holes 151. The toner in the toner recovery chamber 152 can be returned to the main chamber 100*c* through the recovery holes 151.

In an aspect of the present general inventive concept, a toner blocking film 154 can be installed between the member 153 and the guide member 140 to contact an outer surface of the recovery roller 150. An end portion of the toner blocking film 154 can be fixed on the guide member 140, and the other end portion of the toner blocking film 154 can elastically contact the outer surface of the recovery roller 150 at a region where the recovery roller 150 rotates upward in accordance with a motion (or rotation) of a rotary shaft of the recovery roller 150. The toner blocking film 154 can prevent the toner that is supplied to an upper portion of the guide member 140 from the main chamber 100*c*, from leaking to the upper portion of the toner recovery roller 150 in a direction A of FIG. 4 through the recover hole 151 to be transferred to the toner recovery chamber 152.

In another aspect of the present general inventive concept the toner blocking film 154 can be fabricated using an elastic film having a predetermined thickness, for example, polyethyleneterephthalate (PET) film to contact the recovery roller 150 smoothly.

Figure 6:
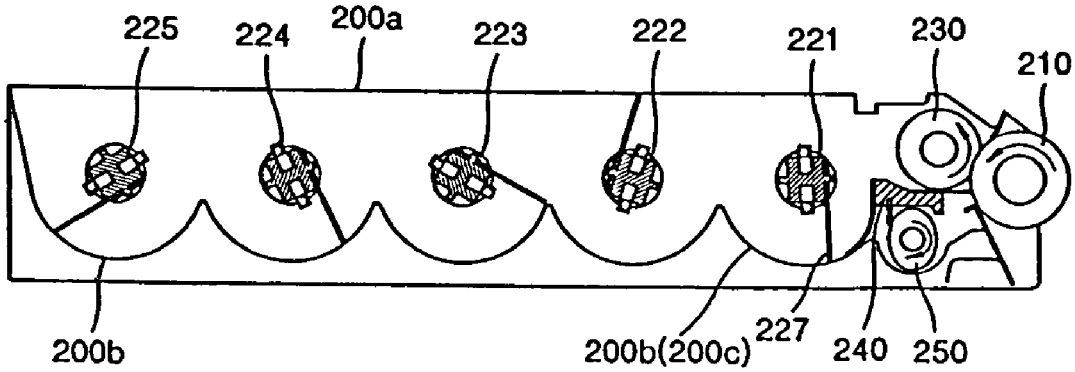
FIG. 6 is a cross-sectional view illustrating a toner cartridge according to anther embodiment of the present general inventive concept.
Figure 7:
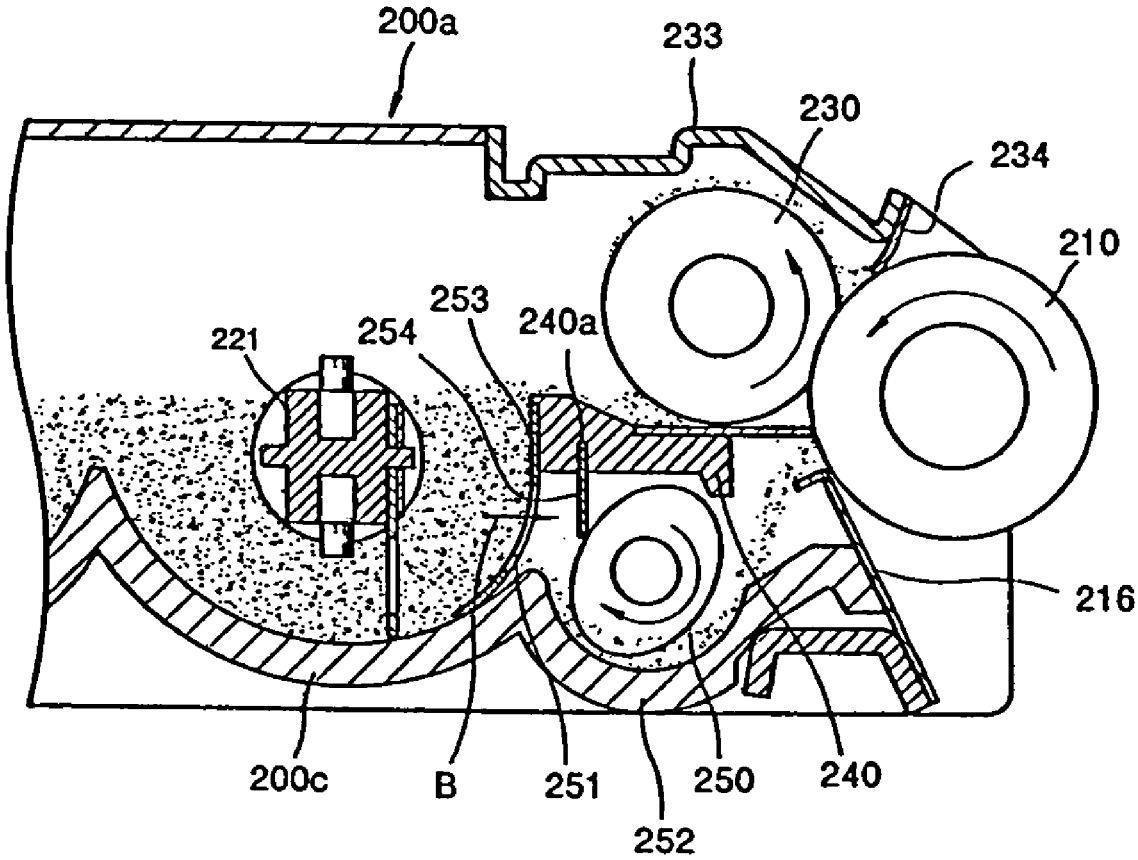
FIG. 7 is an enlarged view illustrating a part of the toner cartridge of FIG. 6.

FIG. 6 is a cross-sectional view illustrating a toner cartridge according to another embodiment of the present general inventive concept, and FIG. 7 is an enlarged view of a part of the toner cartridge of FIG. 6. Same reference numerals are used for same elements as those of the above embodiment, and detailed descriptions for those are omitted.

Referring to FIGS. 6 and 7, five semicircular chambers 200*b* can be sequentially disposed on a lower portion of a housing 200*a*, and each of the chambers 200*b* can include an agitator 221, 222, 223, 224, or 225. A developing roller 210 can be installed on a front end portion of the housing 200*a*, and a toner supplying roller 230 can contact the developing roller 210. A guide member 240 can be disposed under the toner developing roller 230 to receive the toner supplied from the first agitator 221 and to control the toner to be attached to an outer circumference of the toner supplying roller 230. A recovery roller 250 can be disposed under the guide member 240 to return the toner that is not supplied to the developing roller 210 from the toner supplying roller 230, toward a main chamber 200*c* where the first agitator 221 is installed.

A doctor blade 216 can be installed at the housing 200*a* to control the toner on the surface of the developing roller 210 that rotates, and removes an excessive toner from the developing roller 210. A seal film 234 can be installed to prevent the toner from leaking outward.

A seal bracket 233 can be installed on an upper portion of the housing 200*a* to cover the developing roller 210 and the toner supplying roller 230 and to prevent the toner from leaking.

A member 253 can be installed to block an opening formed between the guide member 240 and the main chamber 200*c* is installed. A plurality of recovery holes 251 can be formed at the member 253, and the toner in a toner recovery chamber 252 can be returned to the main chamber 200*c* through the recovery holes 251.

An elongated recess 240*a* can be formed on a lower portion of the guide member 240 in a direction parallel to the recovery roller 250, and a toner blocking film 254 is installed on the elongated recess 240*a*. One end of the toner blocking film 254 can be fixed on the guide member 240, and the other end of the toner blocking film 254 can elastically contract an outer surface of the recovery roller 250 at a region where the recovery roller 250 rotates upward according to a rotation of a rotary shaft of the recovery roller 250. The toner blocking film 254 can prevent the toner that is supplied to an upper portion of the guide member 240 from the main chamber 200*c*, from leaking to an upper portion of the toner recovery roller (a direction B of FIG. 7) through the recovery holes 251 and from being conveyed to the toner recovery chamber 252.

Figure 8:
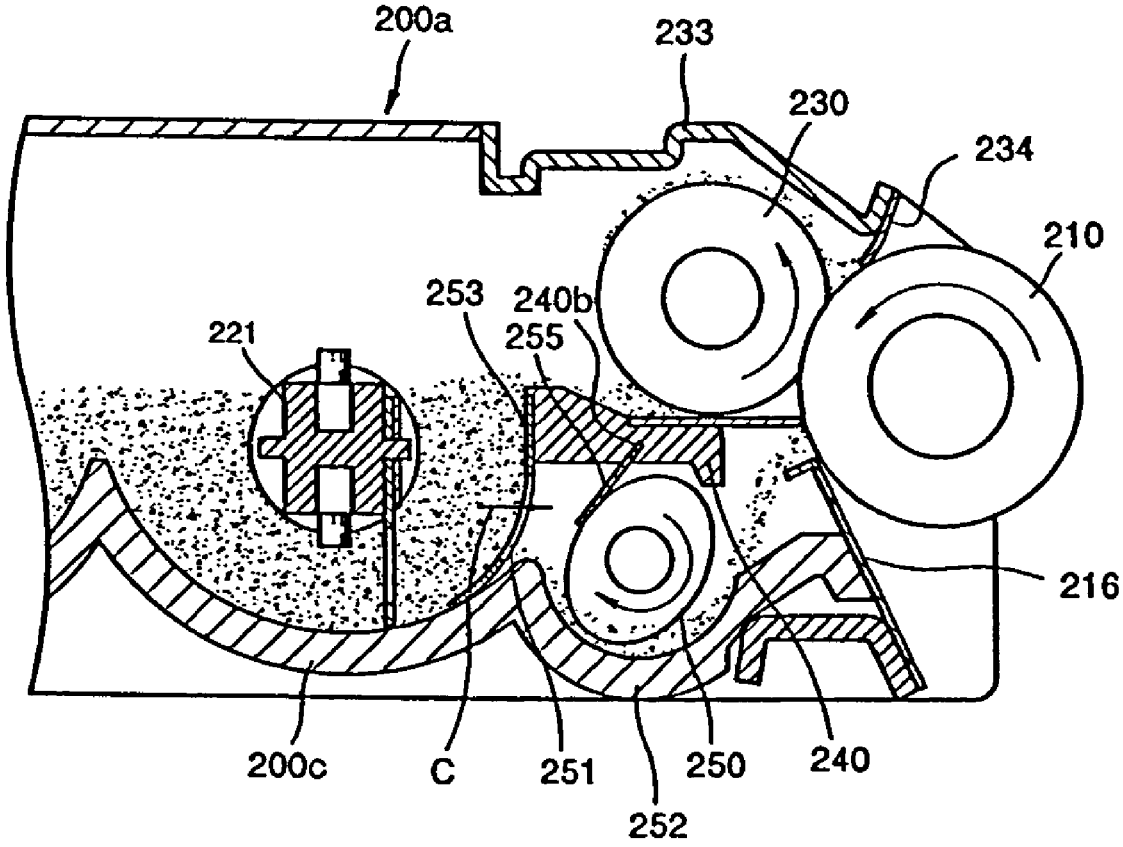
FIG. 8 is a view illustrating a modified example of an elongated recess and a toner blocking film installed on the elongated recess shown in FIG. 7.

FIG. 8 is a view illustrating a modified example of the elongated recess and the toner blocking film installed on the elongated recess of FIG. 7, and same reference numerals are used for the same elements as those of FIG. 7 and detailed descriptions are omitted.

Referring to FIG. 8, an elongated recess 240*b* can be formed on a lower portion of the guide member 240 to be inclined with respect to a vertical plane, and a toner blocking film 255 can be formed on the elongated recess 240*b*. One end of the toner blocking film 255 can be fixedly coupled on the guide member 240, and the other end of the toner blocking film 255 can elastically contact the outer surface of the recovery roller 250 at a region where the recovery roller 250 rotates upward according to a motion (or rotation) of the rotary shaft of the recovery roller 250. The toner blocking film 255 can prevent the toner that is supplied to the upper portion of the guide member 240 from the main chamber 200*c* to the developing roller 210 through the toner supplying roller 230 along a guide path which may be parallel to the arrows A, B, and C of FIGS. 5, 7, and 8, respectively, from leaking to the upper portion of the toner recovery roller (a direction C of FIG. 8) through the recovery holes 251 and from being conveyed to the toner recovery chamber 252.

In the toner cartridge of the present invention, the toner blocking film can be installed on the lower portion of the guide member to prevent the toner supplied to the upper portion of the guide member from leaking to the lower portion of the guide member.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner cartridge used with an electrophotographic image forming apparatus having a photosensitive drum, comprising:

a developing roller that develops an electrostatic latent image formed on an outer circumferential surface of a photosensitive drum;

a toner supplying roller that supplies toner onto the developing roller;

a main chamber that stores the toner;

a guide member that is disposed under the toner supplying roller to receive the toner from the main chamber and to guide the toner toward the developing roller through the toner supplying roller;

a toner recovery chamber that is formed under the guide member to form a space where the toner remaining on the guide member, which is not supplied to the developing roller, can accumulate;

a recovery roller that rotates in the toner recovery chamber to return the toner in the toner recovery chamber to the main chamber; and a toner blocking film that is installed on a lower portion of the guide member to prevent the toner from directly leaking to the toner recovery chamber from the main chamber.

2. The toner cartridge of claim 1, wherein one end of the toner blocking film is installed to contact an outer surface of the recovery roller.

3. The toner cartridge of claim 2, wherein an elongated recess is formed on the lower portion of the guide member in a length direction of the guide member, and the toner blocking film is inserted into the elongated recess.

4. The toner cartridge of claim 3, wherein the elongated recess is inclined at a predetermined angle with respect to a vertical plane.

5. The toner cartridge of claim 4, wherein the toner blocking film comprises one end inserted into the elongated recess and the other end extended from the lower portion of the guide member at the predetermined angle with respect to the vertical plane to contact the outer surface of the recovery roller.

6. The toner cartridge of claim 1, wherein the recovery roller has an oval shape and comprises a plurality of recesses formed thereon to store the toner therein.

7. The toner cartridge of claim 1, wherein the toner blocking film contacts an outer surface of the recovery roller at a region where the recovery roller rotates upward according to a motion of a rotary shaft of the recovery roller.

8. The toner cartridge of claim 1, wherein the toner blocking film comprises an elastic film.

9. A toner cartridge used with an electrophotographic image forming apparatus, comprising:

a housing having a main chamber containing a toner, and an opening;

a guide member disposed to guide the toner from the main chamber toward the opening through a guide path;

a developing roller disposed to supply the guided toner to an outside of the housing through the opening;

a toner recovery chamber disposed opposite to the guide path with respect to the guide member to recover the toner from the developing roller and to store the recovered toner therein;

a toner recovery roller disposed in the toner recovery chamber to transfer the recovered toner from the toner recovery chamber to the main chamber; and a toner blocking film unit disposed between the guide member and the toner recovery roller to prevent the toner from being transferred from the main chamber to the toner recovery chamber.

10. The toner cartridge of claim 9, further comprising:

a second guide member disposed between the main chamber and the guide member to guide the toner to be transferred from the main chamber to the guide member.

11. The toner cartridge of claim 10, wherein the second guide member comprises a film having a hole through which the toner recovery chamber communicates with the main chamber.

12. The toner cartridge of claim 10, wherein the guide member comprises one end disposed adjacent to the main chamber and the other end disposed adjacent to the developing roller, and the second guide member is coupled to the one end of the guide member.

13. The toner cartridge of claim 12, wherein the second guide member comprises a first end connected to the one end of the guide member and a second end extended from the first end toward a bottom surface of the housing defining the main chamber.

14. The toner cartridge of claim 13, wherein the recovery chamber is formed between the guide member and the bottom surface of the housing, and the toner blocking film unit is extended from the guide member toward the bottom surface to contact the recovery roller.

15. The toner cartridge of claim 12, wherein the toner blocking film unit comprises a first end coupled to the one end of the guide member and a second end to contact the recovery roller.

16. The toner cartridge of claim 12, wherein the toner blocking film unit comprises a first end coupled to a portion of the guide member disposed between the one end and the other end of the guide member, and a second end to contact the recovery roller.

17. The toner cartridge of claim 12, wherein the toner blocking film unit comprises a first end coupled to a portion of the guide member disposed between the one end of the guide member and a rotation center of the recovery roller.

18. The toner cartridge of claim 10, wherein the housing comprises a bottom surface and a top surface to define the main chamber, the second guide member is extended from one end of the guide member toward the bottom surface of the housing, and the toner blocking film unit comprises one end disposed between the guide member and the second guide member and the other end extended toward the recovery roller.

19. The toner cartridge of claim 18, wherein the one end of the toner blocking film unit is attached to the guide member, and one end of the second guide member is attached to the one end of the toner blocking film unit.

20. The toner cartridge of claim 10, wherein the one end of the toner blocking film unit is coupled to a portion of the guide member disposed between the second guide member and a line perpendicular to the guiding path and passing through a rotation center of the recovery roller.

21. The toner cartridge of claim 9, wherein the toner is supplied from the main chamber toward the developing roller through the guide path disposed opposite to the toner recovery chamber with respect to the guide member, and the toner is recovered from the developing roller to the main chamber through the toner recovery chamber.

22. The toner cartridge of claim 9, further comprising:

a toner supplying roller disposed opposite to the toner recovery chamber with respect to the guide member between the main chamber and the developing roller to supply the toner from the guide member to the developing roller.

23. The toner cartridge of claim 9, wherein the guide member comprises one end disposed adjacent to the main chamber and the other end disposed adjacent to the developing roller, and the toner blocking film unit comprises one end coupled to a portion of the guide member disposed between the one end of the guide member and a center of the toner recovery roller.

24. The toner cartridge of claim 9, wherein the guide member comprises a recess having an angle with respect to a line perpendicular to the guide path, and a first end of the toner blocking film unit is disposed in the recess of the guide member.

25. The toner cartridge of claim 9, wherein the guide member comprises a recess having an angle with respect to a line having an angle with the guide path, and a first end of the toner blocking film unit is disposed in the recess of the guide member.

26. The toner cartridge of claim 9, wherein the toner blocking film unit is coupled to a portion of the guide member disposed between the main chamber and a line disposed perpendicular to the guide path and passing through a rotation center of the recovery roller.

27. The toner cartridge of claim 9, wherein the toner blocking film unit contacts an outer circumferential surface of the recovery roller in a tangential direction of the recovery roller.

28. An electrophotographic image forming apparatus comprising:

a photosensitive drum; and a toner cartridge comprising, a housing having a main chamber containing a toner, and an opening, a guide member disposed to guide the toner from the main chamber toward the opening through a guide path, a developing roller disposed to supply the toner to the photosensitive drum disposed outside the housing through the opening, a toner recovery chamber formed between the guide member and a bottom surface of the housing and disposed opposite to the guide path with respect to the guide member to recover the toner from the developing roller, a toner recovery roller disposed in the toner recovery chamber to transfer the recovered toner from the toner recovery chamber to the main chamber, and a toner blocking film unit disposed between the guide member and the toner recovery roller to prevent the toner from being transferred from the main chamber to the toner recovery chamber.

29. The electrophotographic image forming apparatus of claim 28, wherein the toner cartridge comprises a second guide member disposed between the main chamber and the guide member to guide the toner to be transferred from the main chamber to the guide member.

* * * * *